US009013259B2

(12) United States Patent
Ikriannikov

(10) Patent No.: US 9,013,259 B2
(45) Date of Patent: Apr. 21, 2015

(54) POWDER CORE MATERIAL COUPLED INDUCTORS AND ASSOCIATED METHODS

(75) Inventor: Alexandr Ikriannikov, Castro Valley, CA (US)

(73) Assignee: Volterra Semiconductor Corporation, San Jose, CA (US)

( * ) Notice: Subject to any disclaimer, the term of this patent is extended or adjusted under 35 U.S.C. 154(b) by 274 days.

(21) Appl. No.: 12/786,301

(22) Filed: May 24, 2010

(65) Prior Publication Data

US 2011/0286143 A1 Nov. 24, 2011

(51) Int. Cl.

| | |
|---|---|
| ***H01F 27/02*** | (2006.01) |
| ***H01F 27/29*** | (2006.01) |
| ***H01F 5/00*** | (2006.01) |
| ***H01F 27/28*** | (2006.01) |
| ***H01F 17/04*** | (2006.01) |
| ***H01F 41/02*** | (2006.01) |

(52) U.S. Cl.
CPC ..... *H01F 17/04* (2013.01); *H01F 41/0246* (2013.01); *H01F 2017/048* (2013.01)

(58) Field of Classification Search
USPC ..... 336/83, 192, 200, 222, 232
See application file for complete search history.

(56) References Cited

U.S. PATENT DOCUMENTS

| | | | | |
|---|---|---|---|---|
| 3,448,421 | A | 6/1969 | Berg et al. | |
| 3,574,685 | A | 4/1971 | Haines | |
| 4,543,554 | A | 9/1985 | Muellenheim et al. | |
| 4,636,752 | A | 1/1987 | Saito | |
| 5,023,578 | A | 6/1991 | Keneko et al. | |
| 5,123,989 | A | 6/1992 | Horiishi et al. | |
| 5,353,001 | A | 10/1994 | Meinel et al. | |
| 5,469,334 | A | 11/1995 | Balakrishnan | |
| 5,565,837 | A | 10/1996 | Godek et al. | |
| 5,568,111 | A | 10/1996 | Metsler | |
| 5,574,420 | A | 11/1996 | Roy et al. | |
| 5,631,822 | A | 5/1997 | Silberkleit et al. | |
| 5,731,666 | A * | 3/1998 | Folker et al. | 315/276 |
| 5,939,966 | A | 8/1999 | Shin' Ei | |
| 6,060,977 | A | 5/2000 | Yamamoto et al. | |

(Continued)

FOREIGN PATENT DOCUMENTS

| | | |
|---|---|---|
| EP | 1 632 964 | 3/2006 |
| EP | 1 833 165 | 9/2007 |

(Continued)

OTHER PUBLICATIONS

Cooper Bussmann, "Product Data Sheet for Low Profile Inductor (Surface Mount)" retrieved from http://www.angliac.com, May 2003.

(Continued)

*Primary Examiner* — Tsz Chan
(74) *Attorney, Agent, or Firm* — Lathrop & Gage LLP

(57) ABSTRACT

A multi-phase coupled inductor includes a magnetic core formed of a powder magnetic material and first, second, third, and fourth terminals. The coupled inductor further includes a first winding forming at least one turn and at least partially embedded in the core and a second winding forming at least one turn and at least partially embedded in the core. The first winding is electrically coupled between the first and second terminals, and the second winding electrically is coupled between the third and fourth terminals. The second winding is at least partially physically separated from the first winding within the magnetic core. The multi-phase coupled inductor is, for example, used in a power supply.

15 Claims, 10 Drawing Sheets

(56) References Cited

U.S. PATENT DOCUMENTS

| | | | | |
|---|---|---|---|---|
| 6,114,932 | A | 9/2000 | Wester et al. | |
| 6,198,375 | B1 | 3/2001 | Shafer | |
| 6,204,744 | B1 | 3/2001 | Shafer et al. | |
| 6,342,778 | B1 | 1/2002 | Catalano et al. | |
| 6,362,986 | B1 | 3/2002 | Schultz et al. | |
| 6,377,155 | B1 | 4/2002 | Allen et al. | |
| 6,388,896 | B1 | 5/2002 | Cuk | |
| 6,420,953 | B1 | 7/2002 | Dadafshar | |
| 6,449,829 | B1 | 9/2002 | Shafer | |
| 6,460,244 | B1 | 10/2002 | Shafer et al. | |
| 6,549,111 | B1 | 4/2003 | De Graaf et al. | |
| 6,578,253 | B1 | 6/2003 | Herbert | |
| 6,765,468 | B2 | 7/2004 | Chen et al. | |
| 6,791,444 | B1 | 9/2004 | Masuda et al. | |
| 6,867,678 | B2 | 3/2005 | Yang | |
| 6,885,274 | B2 | 4/2005 | Hsu et al. | |
| 6,980,077 | B1 | 12/2005 | Chandrasekaran et al. | |
| 7,034,645 | B2 | 4/2006 | Shafer et al. | |
| 7,187,263 | B2 | 3/2007 | Vinciarelli | |
| 7,259,648 | B2 * | 8/2007 | Matsutani et al. | 336/200 |
| 7,280,025 | B2 | 10/2007 | Sano | |
| 7,292,128 | B2 | 11/2007 | Hanley | |
| 7,425,883 | B2 * | 9/2008 | Matsutani et al. | 336/83 |
| 7,498,920 | B2 | 3/2009 | Sullivan et al. | |
| 7,525,406 | B1 | 4/2009 | Cheng | |
| 2002/0067234 | A1 | 6/2002 | Kung | |
| 2002/0093413 | A1 | 7/2002 | Shin 'ei | |
| 2003/0052767 | A1 | 3/2003 | Yamanobe et al. | |
| 2004/0017276 | A1 | 1/2004 | Chen et al. | |
| 2004/0113741 | A1 | 6/2004 | Li et al. | |
| 2004/0125628 | A1 | 7/2004 | Yamada et al. | |
| 2004/0160298 | A1 | 8/2004 | Hsu et al. | |
| 2005/0024179 | A1 | 2/2005 | Chandrasekaran et al. | |
| 2005/0128040 | A1 | 6/2005 | Gray et al. | |
| 2006/0038651 | A1 | 2/2006 | Mizushima et al. | |
| 2006/0044101 | A1 | 3/2006 | Frutschy et al. | |
| 2006/0049907 | A1 | 3/2006 | Liu | |
| 2006/0119461 | A1 | 6/2006 | Kawarai | |
| 2006/0145804 | A1 | 7/2006 | Matsutani et al. | |
| 2006/0158297 | A1 | 7/2006 | Sutardja | |
| 2007/0262840 | A1 | 11/2007 | Matsutani et al. | |
| 2008/0012674 | A1 | 1/2008 | Sano et al. | |
| 2008/0024259 | A1 | 1/2008 | Chandrasekaran et al. | |
| 2008/0136576 | A1 | 6/2008 | Emmons et al. | |
| 2008/0150666 | A1 | 6/2008 | Chandrasekaran et al. | |
| 2008/0211613 | A1 * | 9/2008 | Lin et al. | 336/83 |
| 2008/0303624 | A1 * | 12/2008 | Yamada et al. | 336/212 |
| 2009/0040000 | A1 | 2/2009 | Hopper et al. | |
| 2009/0179723 | A1 | 7/2009 | Ikriannikov et al. | |
| 2009/0231081 | A1 | 9/2009 | Ikriannikov et al. | |
| 2009/0237197 | A1 | 9/2009 | Ikriannikov et al. | |
| 2010/0007453 | A1 | 1/2010 | Yan et al. | |
| 2010/0007457 | A1 | 1/2010 | Yan et al. | |
| 2010/0013587 | A1 | 1/2010 | Yan et al. | |
| 2010/0271161 | A1 | 10/2010 | Yan et al. | |
| 2012/0056704 | A1 | 3/2012 | Nagano et al. | |

FOREIGN PATENT DOCUMENTS

| | | |
|---|---|---|
| JP | 2000-164431 | 6/2000 |
| JP | 2005310865 | 11/2005 |
| WO | WO 2006/026674 | 3/2006 |
| WO | WO2009059069 A2 | 5/2009 |

OTHER PUBLICATIONS

Micrometals, Inc., Composite Cores parts listing, 1 page, accessed via the internet at http://www.micrometals.com/pcparts/ccore.html on Dec. 18, 2007.

Panasonic, Power Choke Coil, 2 pages, Jan. 2008.

Pulse, SMT Power Inductors datasheet, 2 pages, Nov. 2007.

Pulse Product News Press Release dated Nov. 25, 2008.

Pulse, SMT Power Inductors Power Beads—PA0766NL Series; pp. 53-55; Mar. 2006.

TSC Pyroferric Composite Toroid datasheet, 1 page, accessed via the internet at http://www.tscinternational.net/comptoroidprint.pdf on Dec. 18, 2007.

Vishay, Low Profile, High Current IHLP Inductor, 3 pages, Jan. 21, 2009.

Vitec, Dual High Frequency High Power Inductor, AF4390A data sheet; date unknown. Applicants do not concede this reference as prior art.

Chandrasekaran , S. et al., "Integrated Magnetics for Interleaved DC-DC Boost for Fuel Cell Powered Vehicles," 35th Annual IEEE Power Electronics Specialists Conferences, 356-61 (2004).

U.S. Appl. No. 13/024,280, Notice of Allowance mailed Dec. 10, 2012, 7 pages.

U.S. Appl. No. 13/024,280, Issue Fee Payment, filed Mar. 11, 2013, 2 pages.

U.S. Appl. No. 13/107,616, Non-Final Rejection mailed Feb. 20, 2013, 12 pages.

International Search Report and Written Opinion issued in PCT Patent Application PCT/US11/37751, Aug. 21, 2012, 11 pages.

Office Action issued in U.S. Appl. No. 13/024,280 dated Jun. 26, 2012, 17 pages.

Response to Office Action in U.S. Appl. No. 13/024,280, filed Oct. 25, 2012, 13 pages.

Notice of Allowance in U.S. Appl. No. 13/024,280 issued Dec. 10, 2012, 9 pages.

U.S. Appl. No. 13/107,616, Response to Non-Final Rejection filed May 20, 2013, 12 pages.

U.S. Appl. No. 13/107,616, Final Rejection issued Sep. 30, 2013, 15 pages.

* cited by examiner

POWDER CORE MATERIAL COUPLED INDUCTORS AND ASSOCIATED METHODS

BACKGROUND

Switching DC-to-DC converters having a multi-phase coupled-inductor topology are described in U.S. Pat. No. 6,362,986 to Schultz et al., the disclosure of which is incorporated herein by reference. These converters have advantages, including reduced ripple current in the inductors and the switches, which enables reduced per-phase inductance and/or reduced switching frequency over converters having conventional multi-phase DC-to-DC converter topologies. As a result, DC-to-DC converters with magnetically coupled inductors achieve a superior transient response without an efficiency penalty when compared to conventional multiphase topologies. This allows a significant reduction in output capacitance resulting in smaller, lower cost solutions.

Various coupled inductors have been developed for use in multi-phase DC-to-DC converters applications. Such prior art coupled inductors typically include two or more windings wound through one or more passageways in a magnetic core. Examples of prior art coupled inductors may be found in U.S. Pat. No. 7,498,920 to Sullivan et al., the disclosure of which is incorporated herein by reference.

SUMMARY

In an embodiment, a multi-phase coupled inductor includes a magnetic core formed of a powder magnetic material and first, second, third, and fourth terminals. The coupled inductor further includes a first winding forming at least one turn and at least partially embedded in the core and a second winding forming at least one turn and at least partially embedded in the core. The first winding is electrically coupled between the first and second terminals, and the second winding electrically is coupled between the third and fourth terminals. The second winding is at least partially physically separated from the first winding within the magnetic core.

In an embodiment, a power supply includes a printed circuit board, a coupled inductor affixed to the printed circuit board, and a first and a second switching circuit affixed to the printed circuit board. The coupled inductor includes a magnetic core formed of a powder magnetic material and first, second, third, and fourth terminals. The coupled inductor further includes a first winding forming at least one turn and at least partially embedded in the core and a second winding forming at least one turn and at least partially embedded in the core. The first winding is electrically coupled between the first and second terminals, and the second winding is electrically coupled between the third and fourth terminals. The second winding is at least partially physically separated from the first winding within the magnetic core. The first switching circuit is electrically coupled to the first terminal and configured to switch the first terminal between at least two different voltage levels. The second switching circuit is electrically coupled to the third terminal and configured to switch the third terminal between at least two different voltage levels. The second and fourth terminals are electrically coupled together.

In an embodiment, a method for forming a multiphase coupled inductor includes (1) positioning a plurality of windings such that each winding of the plurality of windings is at least partially physically separated from each other winding of the plurality of windings, (2) forming a powder magnetic material at least partially around the plurality of windings, and (3) curing a binder of the powder magnetic material.

DETAILED DESCRIPTION OF THE EMBODIMENTS

Figure 1:
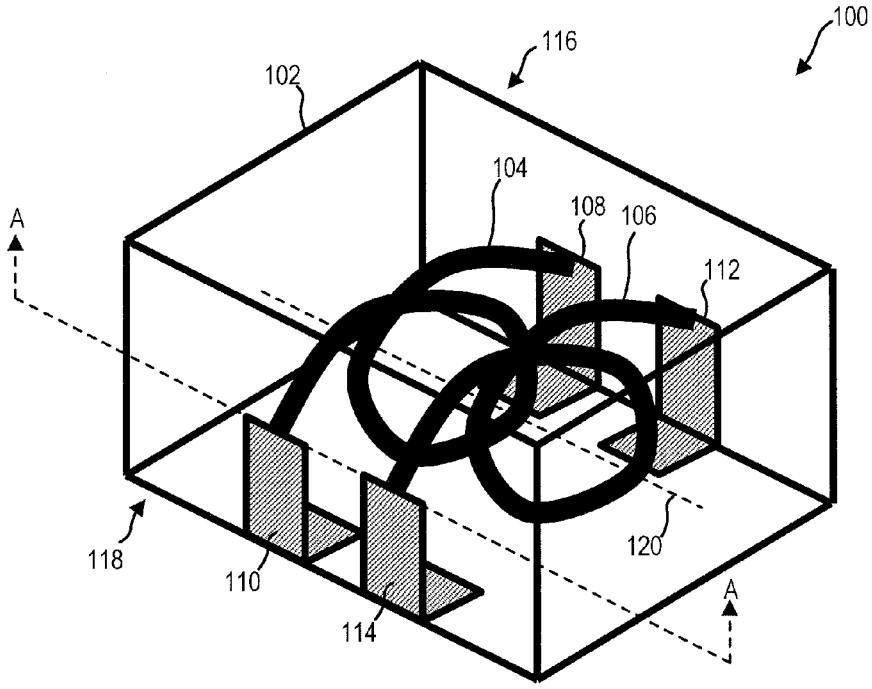
FIG. 1 shows a perspective view.

Disclosed herein, among other things, are coupled inductors that significantly advance the state of the art. In contrast to prior art coupled inductors, the coupled inductors disclosed herein include two or more windings at least partially embedded in a magnetic core formed of a powder magnetic material, such as powdered iron within a binder. Such coupled inductors may have one or more desirable features, as discussed below. In the following disclosure, specific instances of an item may be referred to by use of a numeral in parentheses (e.g., switching node 416(1)) while numerals without parentheses refer to any such item (e.g., switching nodes 416). For purposes of illustrative clarity, certain elements in the drawings may not be drawn to scale.

Figure 2:
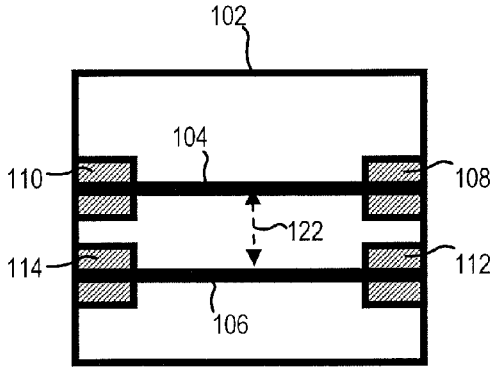
FIG. 2 shows a top cross sectional view of a two phase coupled inductor, according to an embodiment.

FIG. 1 shows one example of a coupled inductor including two or more windings at least partially embedded in a magnetic core formed of a powder magnetic material. Specifically, FIG. 1 shows a perspective view of coupled inductor 100, and FIG. 2 shows a cross sectional view of coupled inductor 100 taken along line A-A of FIG. 1. Inductor 100 includes a magnetic core 102, windings 104, 106, and electrical terminals 108, 110, 112, 114. Core 102, which is shown as transparent in FIG. 1, includes a first side 116 and an opposite second side 118. Core 102 is formed of a powder magnetic material, such as powdered iron within a binder, and provides a path for magnetic flux to magnetically couple together windings 104, 106. Windings 104, 106 each form at least one turn and are at least partially embedded in core 102. Typically, windings 104, 106 are mostly or completely embedded in core 102 to promote strong magnetic coupling between windings 104, 106 and to promote mechanical robustness of coupled inductor 100.

Figure 3:
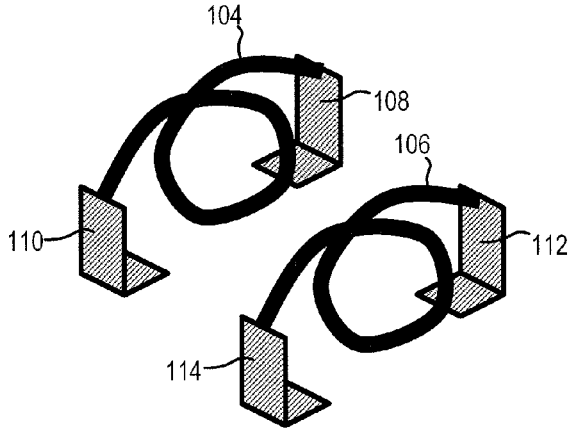
FIG. 3 shows a perspective view of the windings of the coupled inductor of FIGS. 1 and 2 separated from a magnetic core of the inductor.

Winding 104 is electrically coupled between terminals 108, 110, and winding 106 is electrically coupled between terminals 112, 114. Thus, terminals 108, 110 provide electrical interface to winding 104, and terminals 112, 114 provide electrical interface to winding 106. Terminals 108, 112 are disposed proximate to first side 116, and terminals 110, 114 are disposed proximate to second side 118. Terminals 108, 110, 112, 114 may be in form of solder tabs as shown in FIGS. 1-3 such that coupled inductor 100 is suitable for surface mount soldering to a printed circuit board (PCB). Such solder tabs, for example, are discrete components connected (e.g., welded or soldered) to the windings. However, the solder tabs could alternately be formed from the windings themselves, such as by pressing winding ends to form solder tabs. Terminals 108, 110, 112, 114 may also have forms other than solder tabs, such as through-hole pins for soldering to plated PCB through holes.

In certain embodiments, windings 104, 106 are aligned such that they form at least one turn along a common axis 120, which promotes strong magnetic coupling between windings 104, 106. Common axis 120 is, for example, disposed in a horizontal plane of core 102, as shown in FIG. 1. Windings 104, 106 are, for example, formed of wire or foil. FIG. 3 shows a perspective view of windings 104, 106 separate from core 102.

Windings 104, 106 are at least partially separated from each other within core 102 to provide a path for leakage magnetic flux and thereby create leakage inductance when coupled inductor 100 is connected to a circuit. As it is known in the art, coupled inductors must have a sufficiently large leakage inductance in DC-to-DC converter applications to limit ripple current magnitude. In the example of FIGS. 1 and 2, windings 104, 106 are horizontally separated from each other and are completely physically separated from each other by a separation distance 122 (see FIG. 2). Leakage inductance is proportional to separation 122 between windings 104, 106, and leakage inductance can therefore be varied during the design of coupled inductor 100 by varying separation distance 122. Leakage inductance is also inversely proportional to a magnetic permeability of the powder magnetic material of core 102, and leakage inductance can thus be adjusted during the design of coupled inductor 100 by varying the composition of the material forming core 102. In certain embodiments, at least some of the powder core magnetic material between windings 104, 106 has a different composition, such as a different magnetic characteristic, than the power core magnetic material forming other portions of core 102. Such feature may be used, for example, to control separation of windings 104, 106 during core 102's manufacturing, and/or to control magnetic permeability of core 102 in an area between windings 104, 106.

Figure 4:
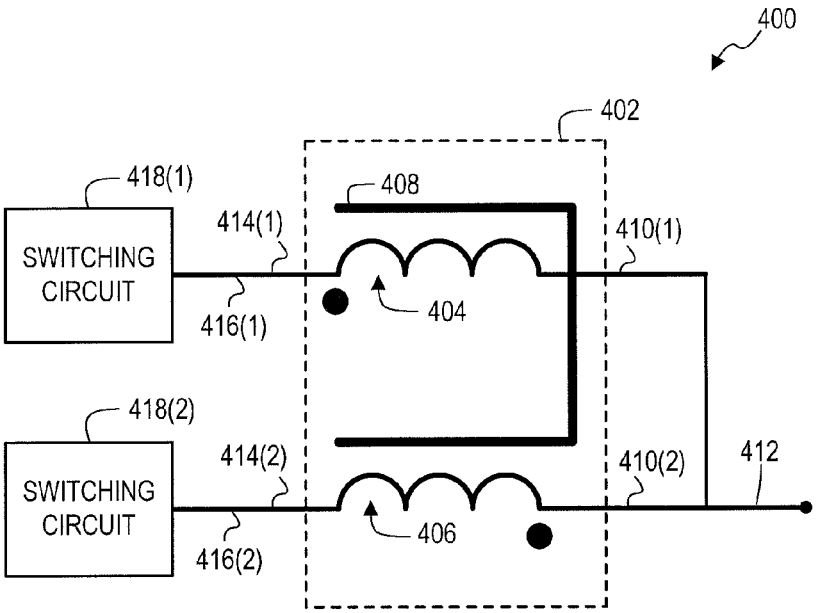
FIG. 4 shows a schematic of a DC-to-DC converter.

As known in the art, coupled inductor windings must be inversely magnetically coupled to realize the advantages discussed above that result from using coupled inductors, instead of multiple discrete inductors, in a multiphase DC-to-DC converter. Inverse magnetic coupling in a two phase DC-to-DC converter application can be appreciated with reference to FIG. 4, which shows a schematic of a two phase DC-to-DC converter 400. DC-to-DC converter 400 includes a coupled inductor 402, having two windings 404, 406, and a magnetic core 408 magnetically coupling the windings 404, 406. A first end 410 of each winding 404, 406 electrically couples to a common node 412, and a second end 414 of each winding 404, 406 electrically couples to a respective switching node 416. A respective switching circuit 418 is also electrically coupled to each switching node 416. Each switching circuit 418 switches its respective second end 414 between at least two different voltage levels. DC-to-DC converter 400, for example, may be configured as a buck converter where switching circuits 418 switch their respective second end 414 between an input voltage and ground, and common node 412 is an output node. In another exemplary embodiment, DC-to-DC converter 400 is configured as a boost converter, where each switching circuit 418 switches its second end 414 between an output node and ground, and common node 412 is an input node.

Coupled inductor 402 is configured such at it has inverse magnetic coupling between windings 404, 406. As a result of such inverse magnetic coupling, a current flowing through winding 404 from switching node 416(1) to common node 412 induces a current flowing through winding 406 from switching node 416(2) to common node 412. Similarly, a current flowing through winding 406 from switching node 416(2) to common node 412 induces a current in winding 404 flowing from switching node 416(1) to common node 412, because of the inverse coupling.

In coupled inductor 100 of FIGS. 1 and 2, windings 104, 106 are configured in core 102 such that a current flowing through winding 104 from first terminal 108 to second terminal 110 induces a current flowing through winding 106 from fourth terminal 114 to third terminal 112. As a result, inverse coupling is achieved in coupled inductor 100 in DC-to-DC converter applications when either first and fourth terminals 108, 114 or second and third terminals 110, 112 are connected to respective switching nodes. Accordingly, the two terminals of coupled inductor 100 connected to switching nodes in DC-to-DC converter applications must each be on opposite sides of core 102 to realize inverse magnetic coupling.

Figure 5:
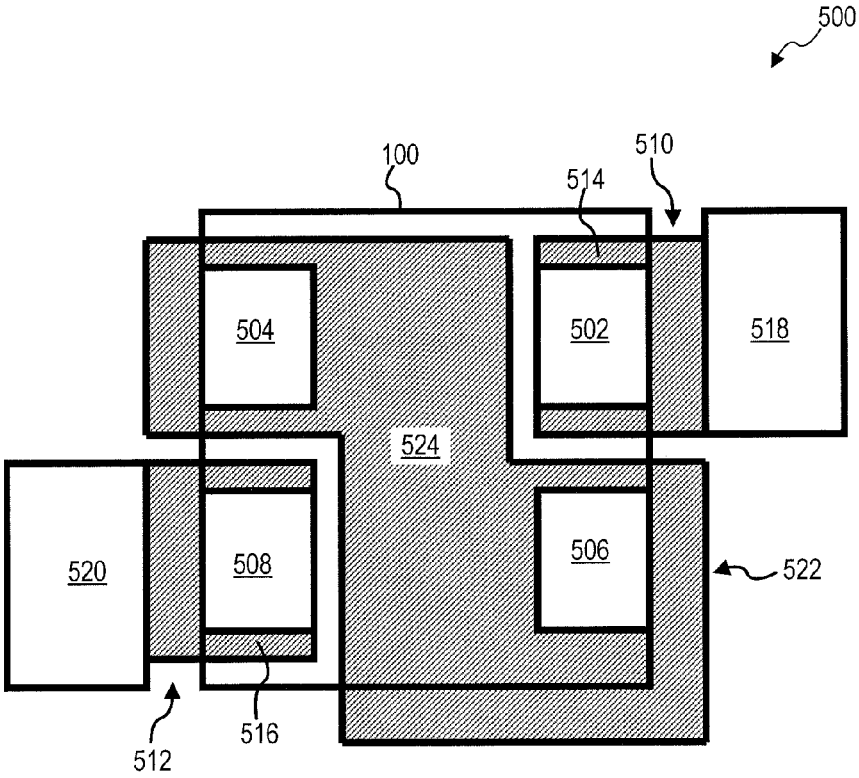
FIG. 5 shows one printed circuit board layout that may be used with certain embodiments of the coupled inductor of FIGS. 1 and 2 in a DC-to-DC converter application.

FIG. 5 shows one PCB layout 500 for use with certain embodiments of coupled inductor 100 in a DC-to-DC converter application. Layout 500 includes pads 502, 504, 506, 508 for respectively coupling to terminals 108, 110, 112, 114 of coupled inductor 100. Pads 502, 508 are respectively coupled to switching nodes 510 and 512 via conductive traces 514, 516, and switching circuits 518, 520 are respectively coupled to switching nodes 510 and 512 via conductive traces 514, 516. Pads 504, 506 connect to a common node 522 via conductive trace 524. Only the outline of coupled inductor 100 is shown in FIG. 5 to show details of layout 500. In certain embodiments, layout 500 forms part of a buck converter where common node 522 is an output node and switching circuits 518, 520 respectively switch switching nodes 510, 512 between an input voltage and ground.

As discussed above, terminals of coupled inductor 100 that are connected to switching nodes are disposed on opposite sides of core 102 to achieve inverse magnetic coupling. Thus, switching node pads 502, 508 are also disposed on opposite sides of coupled inductor 100. Switching circuits 518, 520 are also disposed on opposite sides of coupled inductor 100 in layout 500 because, as known in the art, switching circuits are preferably located near their respective inductor terminals for efficient and reliable DC-to-DC converter operation.

Figure 6:
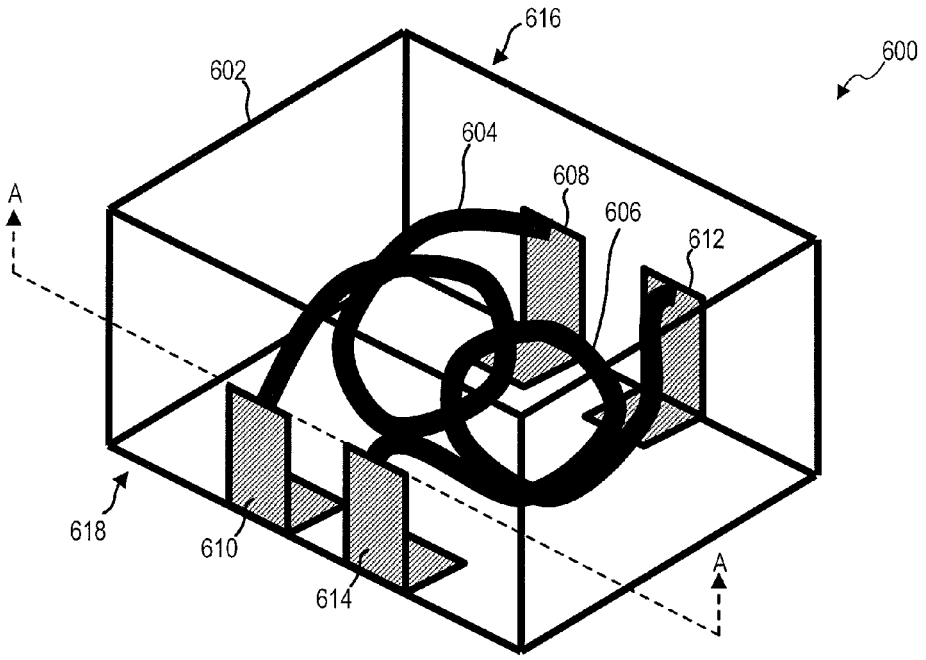
FIG. 6 shows a perspective view.
Figure 7:
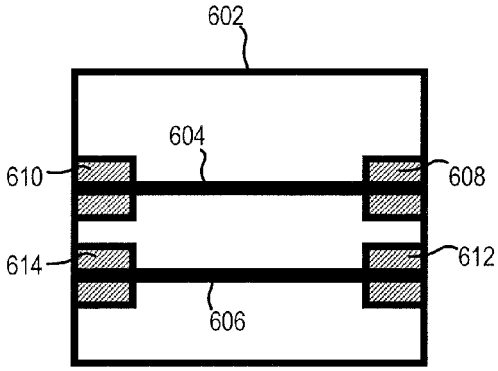
FIG. 7 shows a top cross sectional view of another two phase coupled inductor, according to an embodiment.
Figure 8:
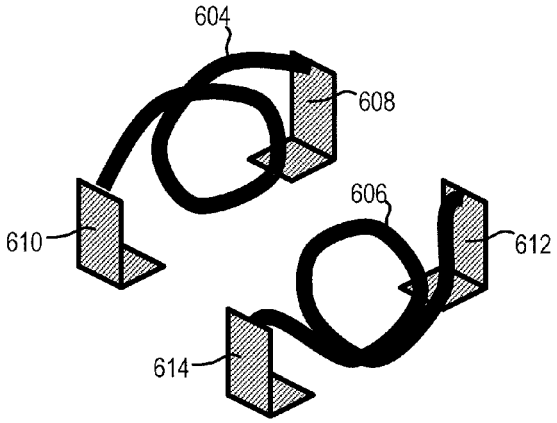
FIG. 8 shows a perspective view of the windings of the coupled inductor of FIGS. 6 and 7 separated from a magnetic core of the inductor.

FIG. 6 shows a perspective view of another coupled inductor 600, and FIG. 7 shows a cross sectional view of coupled inductor 600 taken along line A-A of FIG. 6. Coupled inductor 600 is similar to coupled inductor 100 of FIG. 1 but has a different winding configuration than coupled inductor 100. Coupled inductor 600 includes a magnetic core 602 (shown as transparent in FIG. 6) formed of a powder magnetic material, such as powdered iron within a binder, windings 604, 606, and electrical terminals 608, 610, 612, 614. Terminals 608, 612 are disposed proximate to a first side 616 of core 602, and terminals 610, 614 are disposed proximate to an opposite second side 618 of core 602. Winding 604 is electrically coupled between terminals 608, 610, and winding 606 is electrically coupled between terminals 612, 614. FIG. 8 shows a perspective view of windings 604, 606 separated from core 602.

Figure 9:
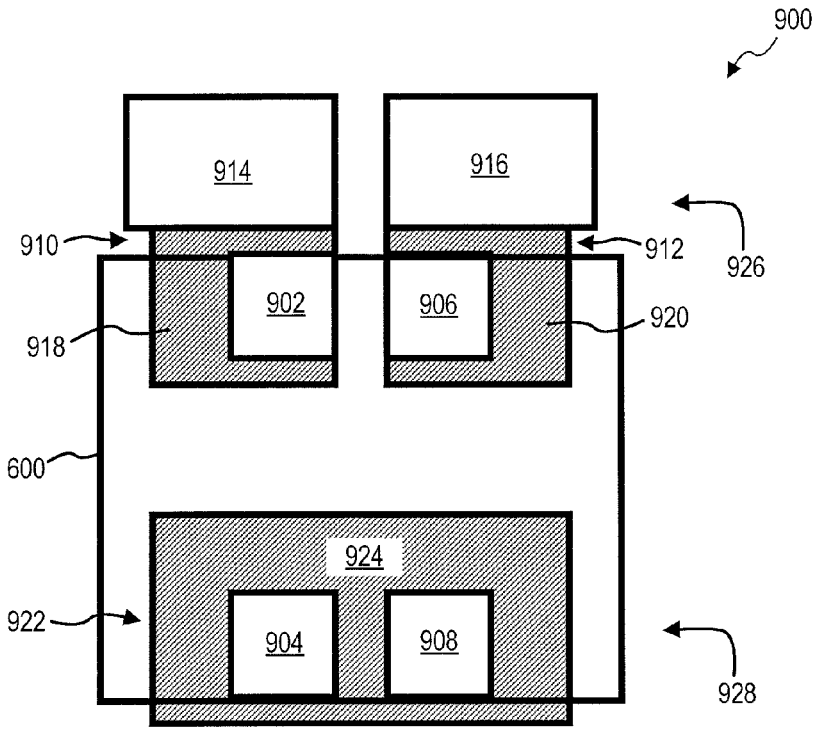
FIG. 9 shows one printed circuit board layout that may be used with certain embodiments of the coupled inductor of FIGS. 6 and 7 in a DC-to-DC converter application.

Windings 604, 606 are configured in core 602 such that an electric current flowing through winding 604 from a first terminal 608 to a second terminal 610 induces an electric current in winding 606 flowing from third terminal 612 to fourth terminal 614. Accordingly, in contrast to coupled inductor 100 of FIG. 1, inverse magnetic coupling is achieved with coupled inductor 600 when terminals on a same side of core 602 are connected to respective switching nodes. For example, FIG. 9 shows one PCB layout 900, which may be used with certain embodiments of coupled inductor 600 in a DC-to-DC converter application. Only the outline of coupled inductor 600 is shown in FIG. 9 to show details of layout 900. Layout 900 includes pads 902, 904, 906, 908 for respectively electrically coupling to terminals 608, 610, 612, 614 of coupled inductor 600. Each of pads 902, 906 electrically couples to a respective switching node 910, 912 and a respective switching circuit 914, 916 via a respective conductive trace 918, 920. Each of pads 904, 908 electrically couples to a common node 922 via a conductive trace 924. In certain embodiments, layout 900 forms part of a buck converter where common node 922 is an output node, and switching circuits 914, 916 respectively switch switching nodes 910, 912 between an input voltage and ground.

Due to inverse magnetic coupling being achieved when terminals on a common side of core 602 are electrically coupled to respective switching nodes, each of switching pads 902, 906 are disposed on a common side 926 of coupled inductor 600 in layout 900. Such feature allows each switching circuit 914, 916 to also be disposed on common side 926, which, for example, promotes ease of PCB layout and may enable use of a common heat sink for the one or more switching devices (e.g., transistors) of each switching circuit 914, 916. Additionally, each of common node pads 904, 908 are also disposed on a common side 928 in layout 900, thereby enabling common node trace 924 to be short and wide, which promotes low impedance and ease of PCB layout. Accordingly, the winding configuration of coupled inductor 600 may be preferable to that of coupled inductor 100 in certain applications.

Figure 10:
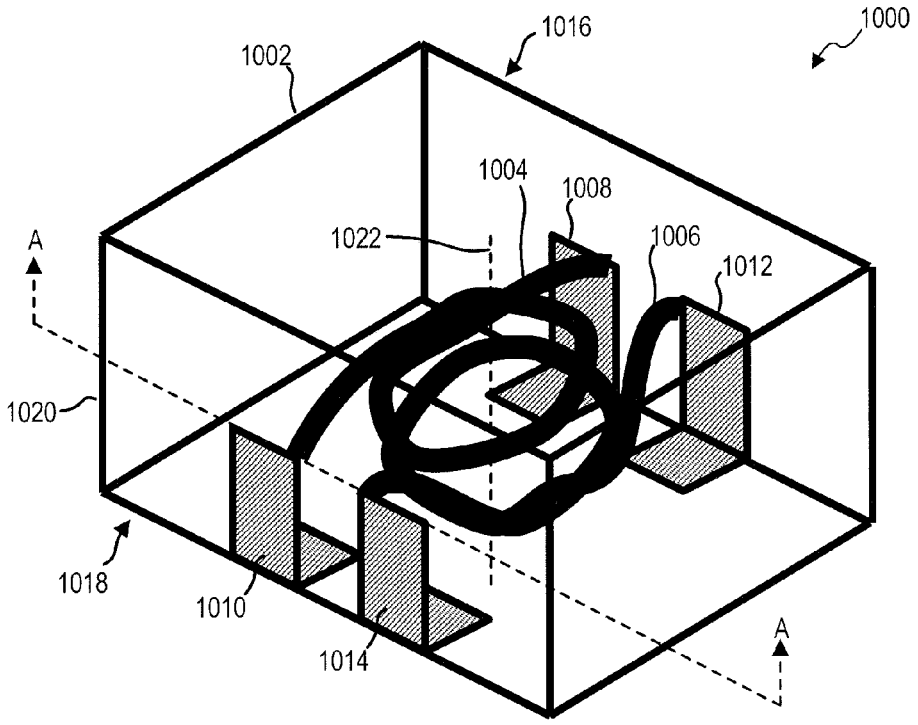
FIG. 10 shows a perspective view.
Figure 11:
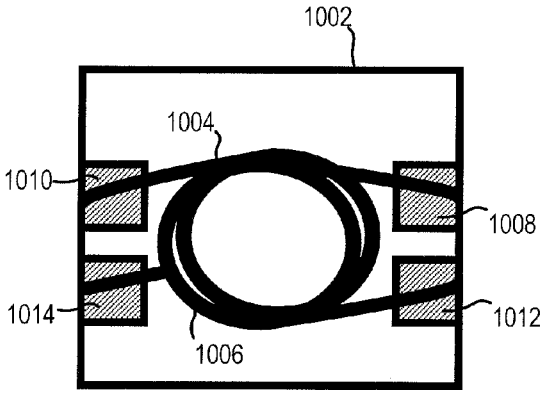
FIG. 11 shows a top cross sectional view of another two phase coupled inductor, according to an embodiment.
Figure 12:
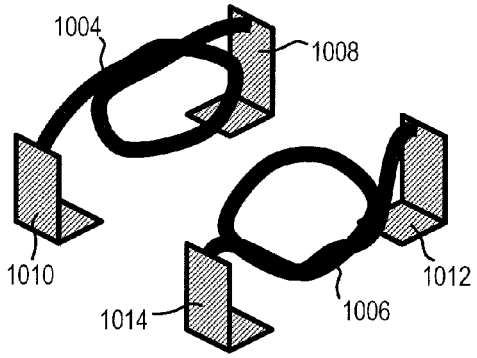
FIG. 12 shows a perspective view of the windings of the coupled inductor of FIGS. 10 and 11 separated from a magnetic core of the inductor.

FIG. 10 shows perspective view of another coupled inductor 1000, which is similar to coupled inductor 100, but has a different winding configuration. Coupled inductor 1000 includes a core 1002, shown as transparent in FIG. 10, formed of a powder magnetic material, such as powdered iron within a binder. Coupled inductor 1000 further includes windings 1004, 1006 at least partially embedded in core 1002 and electrical terminals 1008, 1010, 1012, 1014. Winding 1004 is electrically coupled between terminals 1008, 1010, and winding 1006 is electrically coupled between terminals 1012, 1014. Terminals 1008, 1012 are disposed proximate to a first side 1016 of core 1002, and terminals 1010, 1014 are disposed proximate to a second side 1018 of core 1002. FIG. 11 shows a cross sectional view of coupled inductor 1000 taken along line A-A of FIG. 10, and FIG. 12 shows a perspective view of windings 1004, 1006 separated from core 1002.

In contrast to coupled inductors 100 and 600 of FIGS. 1 and 6 respectively, windings 1004, 1006 are vertically displaced from each other in core 1002—that is, windings 1004, 1006 are displaced from each other along a vertical axis 1020. In certain embodiments, windings 1004, 1006 form at least one turn around a common axis 1022 to promote strong magnetic coupling between windings 1004, 1006. Axis 1022 is, for example, disposed in a vertical plane in core 1002 or parallel to vertical axis 1020, as shown in FIG. 10. Similar to coupled inductors 100 and 600, leakage inductance of coupled inductor 1000 when installed in a circuit is proportional to physical separation between windings 1004, 1006. Windings 1004, 1006 are configured in core 1002 such that a current flowing through winding 1004 from first terminal 1008 to second terminal 1010 induces a current through winding 1006 from third terminal 1012 to fourth terminal 1014. Thus, inverse magnetic coupling is achieved with coupled inductor 1000 in DC-to-DC converter applications when either terminals 1008, 1012 or 1010, 1014 are electrically coupled to respective switching nodes. Accordingly, certain embodiments of coupled inductor 1000 can be used with layout 900 of FIG. 9.

Figure 13:
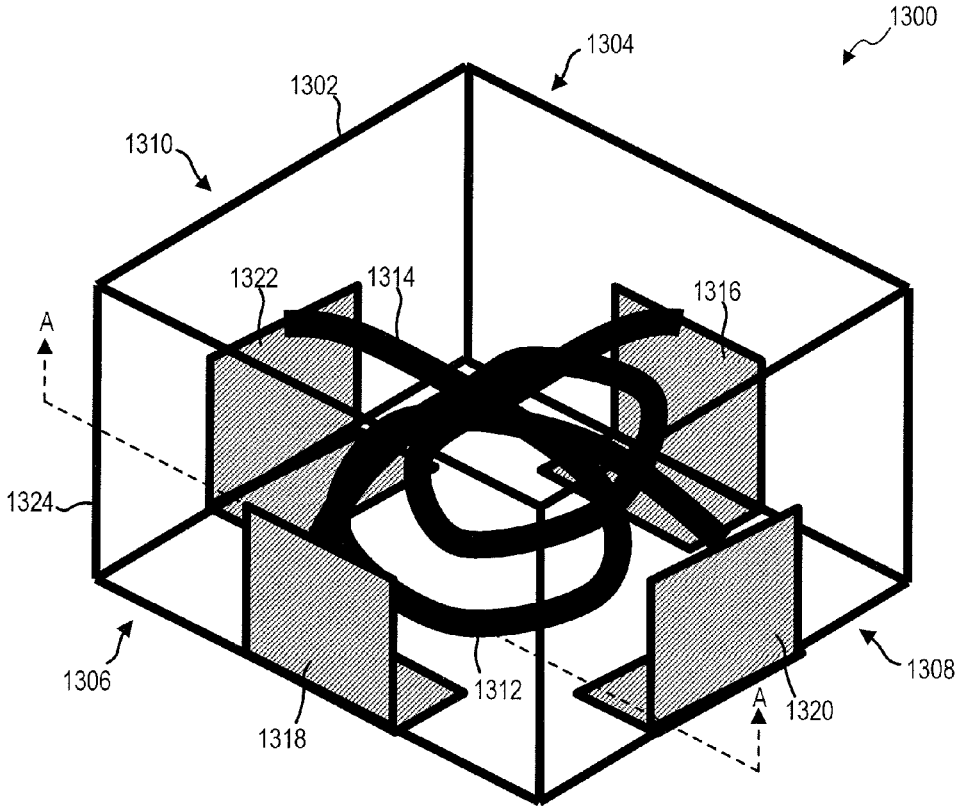
FIG. 13 shows a perspective view.
Figure 14:
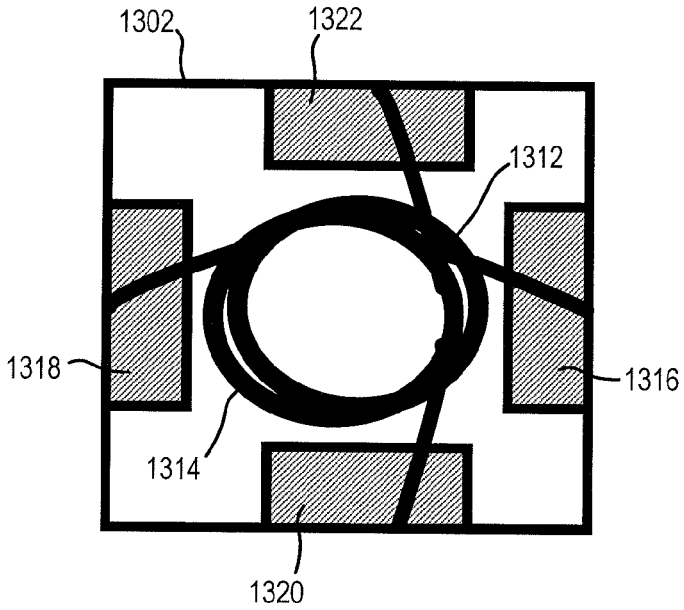
FIG. 14 shows a top cross sectional view of another two phase coupled inductor, according to an embodiment.

FIGS. 13-14 show yet another variation of coupled inductor 100. Specifically, FIG. 13 shows a perspective view of one coupled inductor 1300, and FIG. 14 shows a cross sectional view of coupled inductor 1300 taken along line A-A of FIG. 13. Coupled inductor 1300 is similar to coupled inductor 100, but includes a different winding configuration. Coupled inductor 1300 includes a core 1302, shown as transparent in FIG. 13, which is formed of a powder magnetic material, such as powdered iron within a binder. Core 1302 includes first side 1304, second side 1306, third side 1308, and fourth side 1310. First side 1304 is opposite of second side 1306, and third side 1308 is opposite of fourth side 1310.

Figure 15:
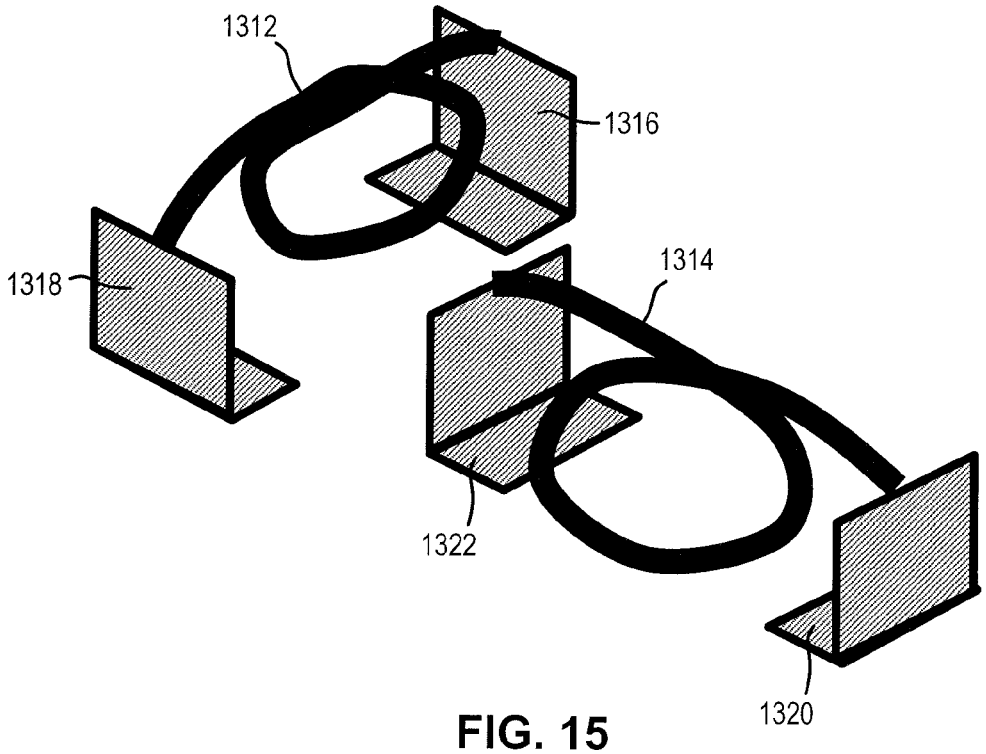
FIG. 15 shows a perspective view of the windings of the coupled inductor of FIGS. 13 and 14 separated from a magnetic core of the inductor.

Coupled inductor 1300 further includes windings 1312, 1314 and electrical terminals 1316, 1318, 1320, 1322. Terminal 1316 is disposed proximate to first side 1304 of core 1302, terminal 1318 is disposed proximate to second side 1306 of core 1302, terminal 1320 is disposed proximate to third side 1308 of core 1302, and terminal 1322 is disposed proximate to fourth side 1310 of core 1302. Winding 1312 is electrically coupled between first and second terminals 1316, 1318, and winding 1314 is electrically coupled between third and fourth terminals 1320, 1322. Windings 1312, 1314 are at least partially embedded in magnetic core 1302, and similar to coupled inductor 1000, windings 1312, 1314 are vertically displaced from each other along a vertical axis 1324. FIG. 15 shows a perspective view of windings 1312, 1314 separated from core 1302.

A current flowing through winding 1312 from first terminal 1316 to second terminal 1318 induces a current in winding 1314 flowing from third terminal 1320 to fourth terminal 1322. Accordingly, inverse magnetic coupling between windings 1312, 1314 in a DC-to-DC converter application can be achieved, for example, with either first and third terminals 1316, 1320, or second and fourth terminals 1318, 1322, electrically coupled to respective switching nodes.

Figure 16:
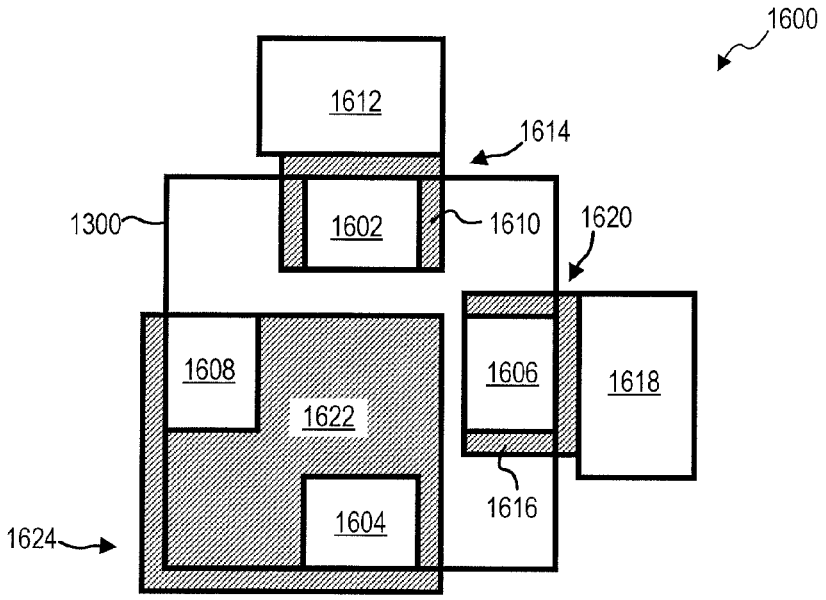
FIG. 16 shows one printed circuit board layout that may be used with certain embodiments of the coupled inductor of FIGS. 13 and 14 in a DC-to-DC converter application.

For example, FIG. 16 shows one PCB layout 1600, which is one example of a PCB layout that may be used with certain embodiments of coupled inductor 1300 in a DC-to-DC converter application. Layout 1600 includes pads 1602, 1604, 1606, 1608 for respectively coupling to terminals 1316, 1318, 1320, 1322 of coupled inductor 1300. Only the outline of coupled inductor 1300 is shown in FIG. 16 to show the pads of layout 1600. A conductive trace 1610 connects pad 1602 and a switching circuit 1612 to a first switching node 1614, and a conductive trace 1616 connects pad 1606 and a switching circuit 1618 to a second switching node 1620. A conductive trace 1622 connects pads 1604, 1608 to a common node 1624. It should be noted that conductive trace 1622 is short and wide in layout 1600, thereby promoting low impedance on common node 1624. In certain embodiments, layout 1600 forms part of a buck converter where common node 1624 is an output node, and switching circuits 1612, 1618 respectively switch switching nodes 1614, 1620 between an input voltage and ground.

Figure 17:
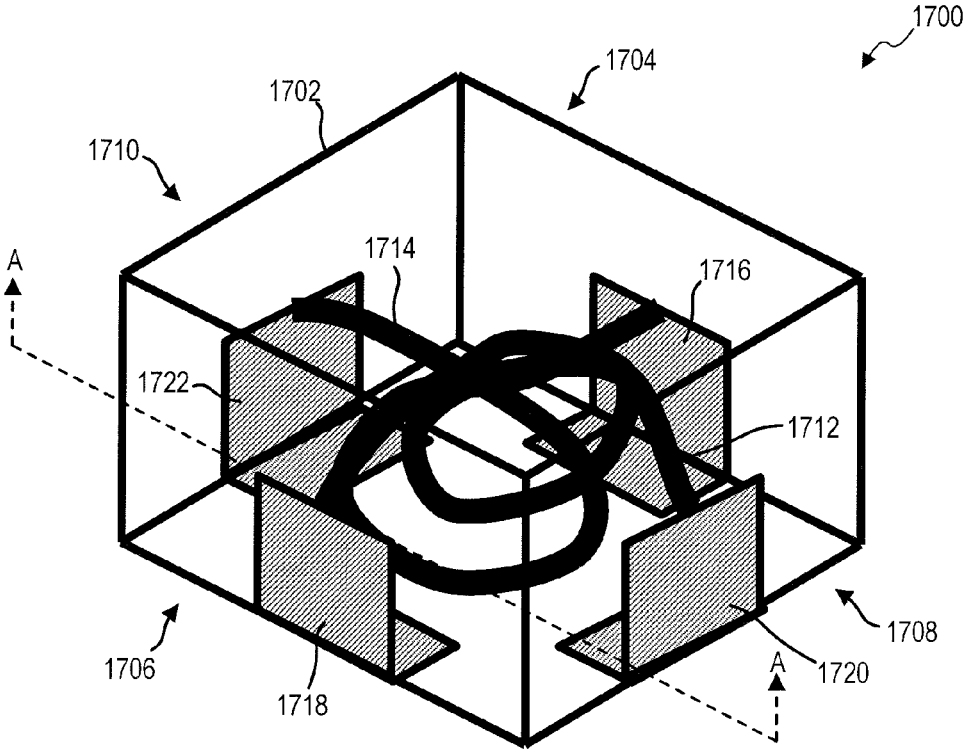
FIG. 17 shows a perspective view.
Figure 18:
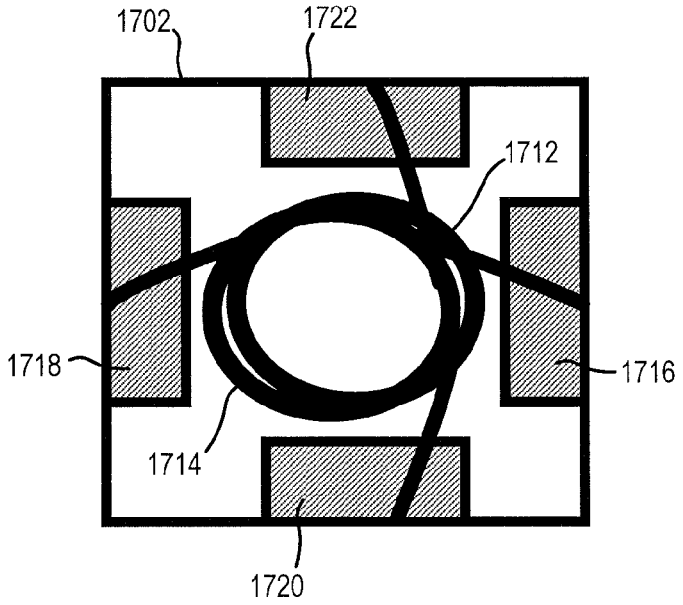
FIG. 18 shows a top cross sectional view of another two phase coupled inductor, according to an embodiment.

FIG. 17 shows a perspective view of another coupled inductor 1700, and FIG. 18 shows a cross sectional view of inductor 1700 taken along line A-A of FIG. 17. Coupled inductor 1700 is similar to coupled inductor 1300 of FIG. 13, but with a different winding configuration. Coupled inductor 1700 includes a magnetic core 1702 formed of a powder magnetic material, such as powdered iron within a binder. Core 1702 is shown as transparent in FIG. 17, and core 1702 includes a first side 1704, a second side 1706, a third side 1708, and a fourth side 1710.

Figure 19:
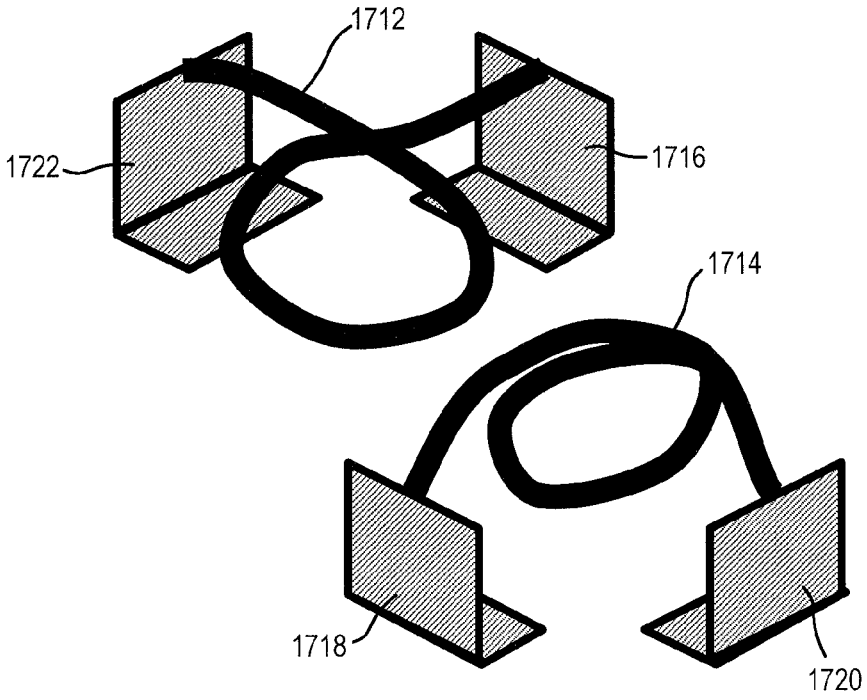
FIG. 19 shows a perspective view of the windings of the coupled inductor of FIGS. 17 and 18 separated from a magnetic core of the inductor.

Coupled inductor 1700 further includes windings 1712, 1714, and terminals 1716, 1718, 1720, 1722. Terminal 1716 is disposed proximate to first side 1704, terminal 1718 is disposed proximate to second side 1706, terminal 1720 is disposed proximate to third side 1708, and terminal 1722 is disposed proximate to fourth side 1710. Winding 1712 is electrically coupled between first and fourth terminals 1716, 1722, and winding 1714 is electrically coupled between second and third terminals 1718, 1720. FIG. 19 shows a perspective view of windings 1712, 1714 separated from core 1702.

An electric current flowing through winding 1712 from fourth terminal 1722 to first terminal 1716 induces a current flowing through winding 1714 flowing from third terminal 1720 to second terminal 1718. Accordingly, inverse magnetic coupling is achieved in DC-to-DC converter applications when either first and second terminals 1716, 1718 or third and fourth terminals 1720, 1722 are electrically coupled to respective switching nodes.

Figure 20:
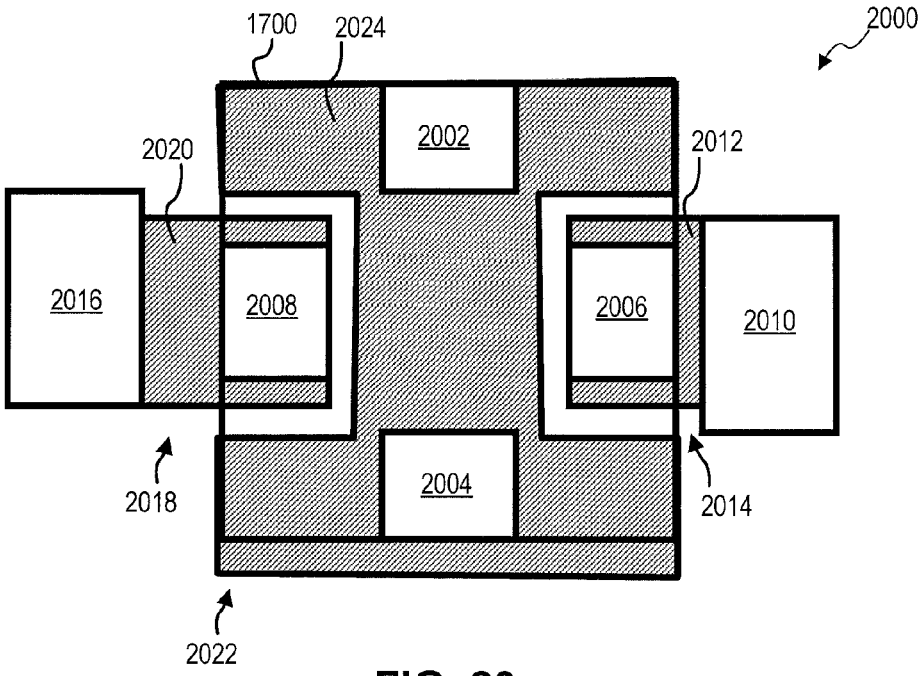
FIG. 20 shows one printed circuit board layout that may be used with certain embodiments of the coupled inductor of FIGS. 17 and 18 in a DC-to-DC converter application.

FIG. 20 shows one layout 2000 that may be used with certain embodiments of coupled inductor 1700 in a DC-to-DC converter application. Layout 2000 includes first, second, third, and fourth solder pads 2002, 2004, 2006, 2008 for respectively coupling to terminals 1716, 1718, 1720, 1722 of coupled inductor 1700. Pad 2006 and a switching circuit 2010 connected to first switching node 2012 via a conductive trace 2014, and pad 2008 and a second switching circuit 2016 connect to a second switching node 2018 via a conductive trace 2020. Pads 2002, 2004 are electrically coupled to common output node 2022 via a conductive trace 2024. Only the outline of coupled inductor 1700 is shown in FIG. 20 to show the pads of layout 2000.

Certain embodiments of the powder magnetic core coupled inductors disclosed herein may have one or more desirable characteristics. For example, because the windings of the powder magnetic core coupled inductors are at least partially embedded in a magnetic core, they do not necessarily need to be wound through a passageway of a magnetic core, thereby promoting low cost and manufacturability, particularly in embodiments with multiple turns per winding. As another example, certain embodiments of the powder magnetic core coupled inductors may be particularly mechanically robust because their windings are embedded in, and thereby protected by, the magnetic core. In yet another exemplary embodiment, leakage inductance of certain embodiments of the powder magnetic core coupled inductors can be adjusted during the design stage merely by adjusting a separation between windings in the magnetic core.

Although the examples above show one turn per winding, it is anticipated that certain alternate embodiments of the powder magnetic core coupled inductors discussed herein will form two or more turns per winding. Additionally, although windings are electrically isolated from each other within the magnetic cores in the examples discussed above, in certain alternate embodiments, two or more windings are electrically coupled together, or ends of two or more windings are connected to a single terminal. Such alternate embodiments may be useful in applications where respective ends of two or more windings are connected to a common node (e.g., a buck converter output node or a boost converter input node). For example, in an alternate embodiment of coupled inductor 600 (FIG. 6), winding 604 is electrically coupled between first and second terminals 608, 610, winding 606 is electrically coupled between third and second terminals 612, 610, and fourth terminal 614 may be eliminated.

Figure 21:
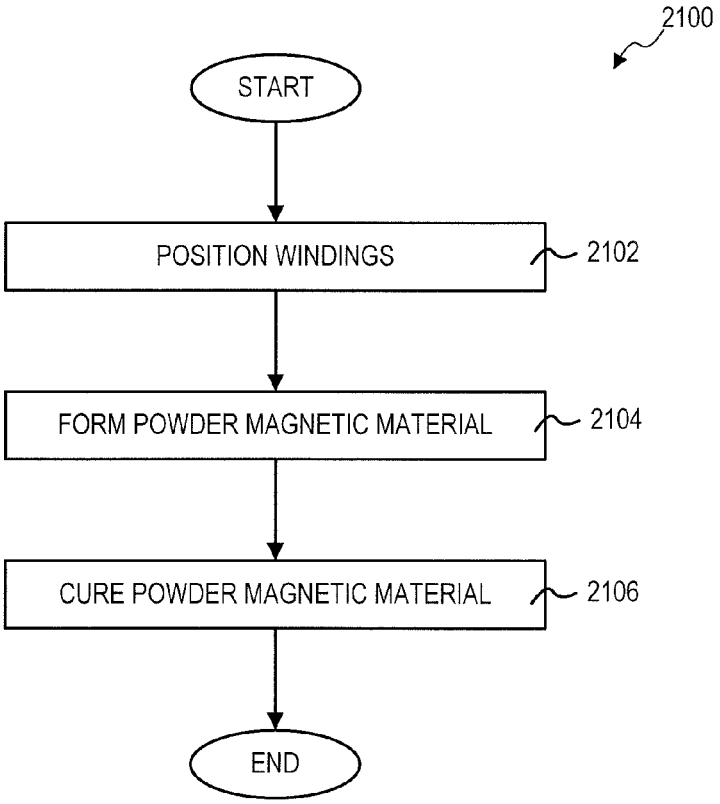
FIG. 21 illustrates a method for forming a multiphase coupled inductor, according to an embodiment.

FIG. 21 illustrates one method 2100 for forming powder magnetic core coupled inductors. Method 2100 may be used to form certain embodiments of the powder magnetic core coupled inductors discussed above. However, method 2100 is not limited to forming such embodiments, and the embodiments discussed above may be formed by methods other than method 2100.

Method 2100 includes step 2102 of positioning a plurality of windings such that each of the plurality of windings is at least partially physically separated from each other of the plurality of windings. An example of step 2102 is positioning windings 104, 106 of FIG. 1 such that they are separate from each other. The windings are, for example, completely physically separated and/or aligned to form at least one turn around a common axis, such as shown in FIG. 1. In step 2104, a powder magnetic material is formed at least partially around the plurality of windings positioned in step 2102. An example of step 2102 is forming a powder magnetic material including powdered iron or a similar magnetic powder within a binder around windings 104, 106 of FIG. 1. In step 2106, the binder of the powder magnetic material formed in step 2104 is cured (e.g., heated, subjected to pressure, and/or subjected to one or more chemicals). An example of step 2106 is sintering the powder magnetic material formed around windings 104, 106 of FIG. 1 to form magnetic core 102.

As discussed above, one possible use of the coupled inductors disclosed herein is in switching power supplies, such as in switching DC-to-DC converters. Accordingly, the powder magnetic material used to form the magnetic cores is typically a material that exhibits a relatively low core loss at high switching frequencies (e.g., at least 20 KHz) that are common in switching power supplies.

Figure 22:
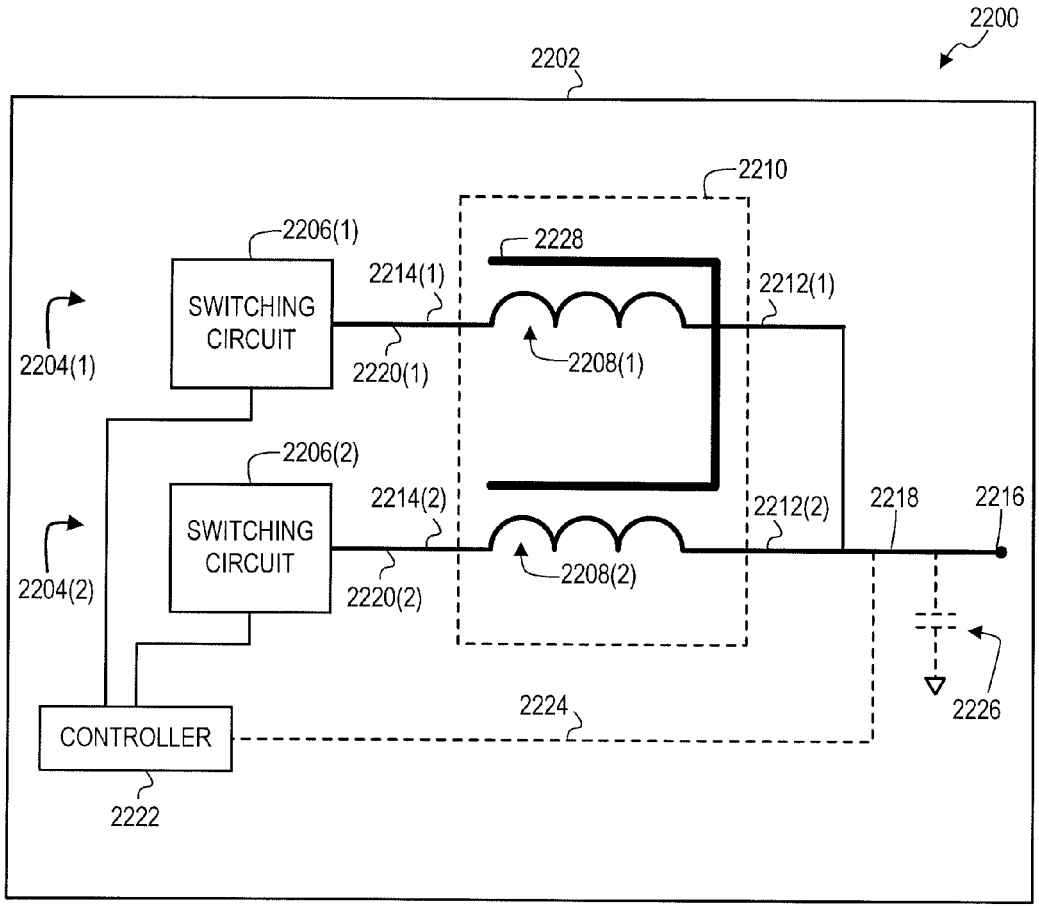
FIG. 22 shows one power supply, according to an embodiment.

FIG. 22 schematically shows one power supply 2200, which is one possible application of the coupled inductors discussed herein. Power supply 2200 includes a PCB 2202 for supporting and electrically connecting components of power supply 2200. PCB 2202 could alternately be replaced with a number of separate, but electrically interconnected, PCBs.

Power supply 2200 is shown as including two phases 2204, where each phase includes a respective switching circuit 2206 and a winding 2208 of a two-phase coupled inductor 2210. However, alternative embodiments of power supply 2200 may have a different number of phases 2204, such as four phases, where a first pair of phases utilizes windings of a first two-phase coupled inductor, and a second pair of phases utilizes windings of a second two-phase coupled inductor. Examples of two-phase coupled inductor 2210 include coupled inductor 100 (FIG. 1), coupled inductor 600 (FIG. 6), coupled inductor 1000 (FIG. 10), coupled inductor 1300 (FIG. 13), and coupled inductor 1700 (FIG. 17).

Each winding 2208 has a respective first end 2212 and a respective second end 2214. First and second ends 2212, 2214, for example, form surface mount solder tabs suitable for surface mount soldering to PCB 2202. For example, in an embodiment where coupled inductor 2210 is an embodiment of coupled inductor 100 (FIG. 1), first end 2212(1) represents terminal 110, second end 2214(1) represents terminal 108, first end 2212(2) represents terminal 112, and second end 2214(2) represents terminal 114. Each first end 2212 is electrically connected to a common first node 2216, such as via a PCB trace 2218.

Each second end 2214 is electrically connected to a respective switching circuit 2206, such as by a respective PCB trace 2220. Switching circuits 2206 are configured to switch second end 2214 of their respective winding 2208 between at least two different voltage levels. Controller 2222 controls switching circuits 2206, and controller 2222 optionally includes a feedback connection 2224, such as to first node 2216. First node 2216 optionally includes a filter 2226.

Power supply 2200 typically has a switching frequency, the frequency at which switching circuits 2206 switch, of at least about 20 kHz, such that sound resulting from switching is above a frequency range perceivable by humans. Operating switching power supply 2200 at a high switching frequency (e.g., at least 20 kHz) instead of at a lower switching frequency may also offer advantages such as (1) an ability to use smaller energy storage components (e.g., coupled inductor 2210 and filter capacitors), (2) smaller ripple current and ripple voltage magnitude, and/or (3) faster converter transient response. To enable efficient operation at high switching frequencies, the one or more magnetic materials forming a magnetic core 2228 of coupled inductor 2210 are typically materials having relatively low core losses at high frequency operation.

In some embodiments, controller 2222 controls switching circuits 2206 such that each switching circuit 2206 operates out of phase from each other switching circuit 2206. Stated differently, in such embodiments, the switched waveform provided by each switching circuit 2206 to its respective second end 2214 is phase shifted with respect to the switched waveform provided by each other switching circuit 2206 to its respective second end 2214. For example, in certain embodiments of power supply 2200, switching circuit 2206(1) provides a switched waveform to second end 2214(1) that is about 180 degrees out of phase with a switched waveform provided by switching circuit 2206(2) to second end 2214(2).

In embodiments where power supply 2200 is a DC-to-DC converter, it utilizes, for example, one of the PCB layouts discussed above, such as PCB layout 500 (FIG. 5), 900 (FIG. 9), 1600 (FIG. 16), or 2000 (FIG. 20). For example, if power supply 2200 is a DC-to-DC converter using inductor 600 with PCB layout 900, switching circuits 914, 916 of layout 900 correspond to switching circuits 2206(1), 2206(2) of power supply 2200, and switching traces 918, 920 of layout 900 correspond to traces 2220(1), 2220(2) of power supply 2200.

Power supply 2200 can be configured to have a variety of configurations. For example, switching circuits 2206 may switch their respective second ends 2214 between an input voltage node (not shown) and ground, such that power supply 2200 is configured as a buck converter, first node 2216 is an output voltage node, and filter 2226 is an output filter. In this example, each switching circuit 2206 includes at least one high side switching device and at least one catch diode, or at least one high side switching device and at least one low side switching device. In the context of this document, a switching device includes, but is not limited to, a bipolar junction transistor, a field effect transistor (e.g., a N-channel or P-channel metal oxide semiconductor field effect transistor, a junction field effect transistor, or a metal semiconductor field effect transistor), an insulated gate bipolar junction transistor, a thyristor, or a silicon controlled rectifier.

In another exemplary embodiment, power supply 2200 is configured as a boost converter such that first node 2216 is an input power node, and switching circuits 2206 switch their respective second end 2214 between an output voltage node (not shown) and ground. Additionally, power supply 2200 can be configured, for example, as a buck-boost converter such that first node 2216 is a common node, and switching circuits 2206 switch their respective second end 2214 between an output voltage node (not shown) and an input voltage node (not shown).

Furthermore, in yet another example, power supply 2200 may form an isolated topology. For example, each switching circuit 2206 may include a transformer, at least one switching device electrically coupled to the transformer's primary winding, and a rectification circuit coupled between the transformer's secondary winding and the switching circuit's respective second end 2214. The rectification circuit optionally includes at least one switching device to improve efficiency by avoiding forward conduction voltage drops common in diodes.

Changes may be made in the above methods and systems without departing from the scope hereof. For example, although the above examples of powder magnetic core coupled inductors show a rectangular shaped core, core shape could be varied. As another example, the number of windings per inductor and/or the number of turns per winding could be varied. It should thus be noted that the matter contained in the above description and shown in the accompanying drawings should be interpreted as illustrative and not in a limiting sense. The following claims are intended to cover generic and specific features described herein, as well as all statements of the scope of the present method and system, which, as a matter of language, might be said to fall therebetween.

What is claimed is:

1. A multi-phase coupled inductor, comprising:

a magnetic core formed of a powder magnetic material;

first, second, third, and fourth terminals;

a first winding forming at least a first loop, the first loop embedded in the core, the first winding electrically coupled between the first and second terminals; and a second winding forming at least a second loop, the second loop embedded in the core, the second winding electrically coupled between the third and fourth terminals, wherein:

each of the first and second loops are formed around a common axis, when seen looking perpendicular to a plane parallel to the first and second loops, a first portion of the magnetic core separates the first loop from the second loop along the common axis, and at least part of the first portion of the magnetic core that includes the common axis has a different magnetic characteristic from at least one other portion of the magnetic core.

2. The coupled inductor of claim 1, the first winding being electrically isolated from the second winding within the magnetic core.

3. The coupled inductor of claim 1, the first winding being completely physically separated from the second winding within the magnetic core.

4. The coupled inductor of claim 1, each of the first, second, third, and fourth terminals comprising an element selected from the group consisting of a solder tab and a through-hole pin.

5. The coupled inductor of claim 1, the common axis being disposed in a horizontal plane of the magnetic core.

6. The coupled inductor of claim 1, the common axis being disposed in a vertical plane of the magnetic core.

7. The coupled inductor of claim 1, wherein:

the magnetic core comprises a first side and a second side opposite of the first side;

the first and third terminals are disposed proximate to the first side of the core;

the second and fourth terminals are disposed proximate to the second side of the core; and the first and second windings are configured in the core such that an electric current flowing through the first winding from the first terminal to the second terminal induces an electric current in the second winding flowing from the third terminal to the fourth terminal.

8. The coupled inductor of claim 1, wherein:

the magnetic core comprises a first side, a second side, a third side, and a fourth side, the first side being opposite of the second side, the third side being opposite of the fourth side;

the first, second, third, and fourth terminals are respectively disposed proximate to the first, second, third, and fourth sides of the core; and the first and second windings are configured in the core such that an electric current flowing through the first winding from the first terminal to the second terminal induces an electric current in the second winding flowing from the third terminal to the fourth terminal.

9. The coupled inductor of claim 1, wherein:

the magnetic core comprises a first side, a second side, a third side, and a fourth side, the first side being opposite of the second side, the third side being opposite of the fourth side;

the first, second, third, and fourth terminals are respectively disposed proximate to the third, first, fourth, and second sides of the core; and the first and second windings are configured in the core such that an electric current flowing through the first winding from the first terminal to the second terminal induces a current in the second winding flowing from the third terminal to the fourth terminal.

10. A power supply, comprising:

a printed circuit board;

a coupled inductor affixed to the printed circuit board, the coupled inductor including:

a magnetic core formed of a powder magnetic material, first, second, third, and fourth terminals, a first winding forming at least a first loop, the first loop embedded in the core, the first winding electrically coupled between the first and second terminals, and a second winding forming at least a second loop, the second loop embedded in the core, the second winding electrically coupled between the third and fourth terminals, wherein:

each of the first and second loops are formed around a common axis, when seen looking perpendicular to a plane parallel to the first and second loops, a first portion of the magnetic core separates the first loop from the second loop along the common axis, and at least part of the first portion of the magnetic core that includes the common axis has a different magnetic characteristic from at least one other portion of the magnetic core;

a first switching circuit affixed to the printed circuit board and electrically coupled to the first terminal, the first switching circuit configured to switch the first terminal between at least two different voltage levels; and a second switching circuit affixed to the printed circuit board and electrically coupled to the third terminal, the second switching circuit configured to switch the third terminal between at least two different voltage levels;

the second and fourth terminals being electrically coupled together.

11. The power supply of claim 10, each of the first and second switching circuits configured to switch at a frequency of at least 20 kilohertz.

12. The power supply of claim 10, the first winding being electrically isolated from the second winding within the magnetic core, and the first winding being completely physically separated from the second winding within the magnetic core.

13. The power supply of claim 10, wherein:

the magnetic core comprises a first side and a second side opposite of the first side;

the first and third terminals are disposed proximate to the first side of the core;

the second and fourth terminals are disposed proximate to the second side of the core; and the first and second switching circuits are disposed along the first side of the core.

14. The power supply of claim 10, wherein:

the magnetic core comprises a first side, a second side, a third side, and a fourth side, the first side being opposite of the second side, the third side being opposite of the fourth side;

the first, second, third, and fourth terminals are respectively disposed proximate to the first, second, third, and fourth sides of the core; and the first switching circuit is disposed along the first side of the core, and the second switching circuit is disposed along the third side of the core.

15. The power supply of claim 10, wherein:

the magnetic core comprises a first side, a second side, a third side, and a fourth side, the first side being opposite of the second side, the third side being opposite of the fourth side;

the first, second, third, and fourth terminals are respectively disposed proximate to the third, first, fourth, and second sides of the core; and the first switching circuit is disposed along the third side of the core, and the second switching circuit is disposed along the fourth side of the core.

* * * * *